US006730012B2

(12) United States Patent
Bando

(10) Patent No.: US 6,730,012 B2
(45) Date of Patent: May 4, 2004

(54) PROCESS FOR MANUFACTURING SHEET STACK

(75) Inventor: Takeshi Bando, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

(21) Appl. No.: 09/969,388

(22) Filed: Oct. 1, 2001

(65) Prior Publication Data

US 2002/0086787 A1 Jul. 4, 2002

(30) Foreign Application Priority Data

Oct. 4, 2000 (JP) ..... 2000-304628

(51) Int. Cl.[7] ..... B31F 1/30

(52) U.S. Cl. ..... 493/413; 493/416; 493/421; 493/433; 493/440; 270/39; 270/40

(58) Field of Search ..... 493/413, 416, 493/421, 433, 440, 960; 270/39, 40

(56) References Cited

U.S. PATENT DOCUMENTS

| | | | | |
|---|---|---|---|---|
| 3,199,861 A | | 8/1965 | Presnell et al. | |
| 3,401,928 A | * | 9/1968 | Frick | 270/40 |
| 3,817,514 A | * | 6/1974 | Nissen et al. | 270/40 |
| 3,841,620 A | * | 10/1974 | Lee et al. | 270/40 |
| 4,502,675 A | * | 3/1985 | Clark et al. | 270/40 |
| 5,118,554 A | | 6/1992 | Chan et al. | |
| 5,565,258 A | | 10/1996 | McConnell et al. | |
| 5,647,506 A | * | 7/1997 | Julius | 221/46 |
| 6,168,848 B1 | * | 1/2001 | Heath | 221/48 |

FOREIGN PATENT DOCUMENTS

| | | | |
|---|---|---|---|
| EP | 0402324 | 12/1990 | B31D/1/04 |
| EP | 1136412 | 9/2001 | B65H/45/24 |
| JP | 54-83519 | 7/1979 | B65H/45/24 |

* cited by examiner

*Primary Examiner*—Rinaldi I. Rada
*Assistant Examiner*—Michelle Lopez
(74) *Attorney, Agent, or Firm*—Darby & Darby

(57) ABSTRACT

Disclosed is a sheet stack manufacturing process. At first, a plurality of band sheets are fed. Each band sheet is folded at least once along a longitudinal direction thereof at a first folding step, to form folded bands. Then, each folded band is folded along the longitudinal direction at a second folding step to have at least three fold lines by the first and second folding steps and to sandwich a portion of at least one of an overlying sheet and an underlying sheet thereof, thereby to form a band-shaped sheet stack in which a plurality of sheets are combined with one another so as to be stacked on one another. The band-shaped sheet stack is cut to a predetermined length to be separated into individual sheet stacks.

4 Claims, 8 Drawing Sheets

PROCESS FOR MANUFACTURING SHEET STACK

BACKGROUND OF THE INVENTION

1. Field of the Invention

The present invention relates to a process for manufacturing a sheet stack in which sheets of wet tissue paper, wet nonwoven fabric, dry tissue paper or dry nonwoven fabric are so stacked in a folded state that they can be sequentially taken out.

2. Related Art

Wet sheets for wiping hands or anal regions of babies or for cleaning toilets or dining rooms are sealed and accommodated in a packaging member such as a hard container or a bag formed of a packaging sheet, so that they be kept in the wet state. In this packaging member, moreover, there is formed an opening for allowing the sheets to be sequentially taken out. The wet sheets of this kind are combined with the upper and lower ones being connected to each other. When the upper sheet is pulled out of the opening, the lower sheet is dragged by the upper sheet so that an upper portion of the lower sheet may be protruded from the opening.

Examples of the so-called "pop-up type sheet stack" of this kind in the related art are shown in FIGS. 12 and 13.

In a sheet stack 1 shown in FIG. 12, each sheet 2 of a predetermined width is folded in two to have a v-folded structure in which an upper fold is designated by 3 and a lower fold is designated by 4. Between the upper fold 3 and the lower fold 4 of one sheet, moreover, there are sandwiched the lower fold 4 of the overlying sheet and the upper fold 3 of the underlying sheet. Between upper and lower sheets, the upper fold 3 and the lower fold 4 are joined (closely contacted) with each other at an overlap portion of a predetermined width La.

In a sheet stack 5 shown in FIG. 13, each sheet 6 of a predetermined width is folded in three to have a z-folded structure in which an intermediate fold is designated by 7, an upper fold folded back upwardly from the intermediate fold 7 is designated by 8 and a lower fold folded back downwardly from the intermediate fold 7 is designated by 9. Over the lower fold 9 of one sheet, there is laid the upper fold 8 of the underlying sheet. These lower fold 9 and upper fold 8 are joined (closely contacted) with each other at an overlap portion of a predetermined width Lb.

The sheet stacks 1 and 5 are individually accommodated in a packaging member such as a hard container of plastics or a bag formed of a soft packaging sheet. As one sheet is taken out from the opening formed in the upper face of the packaging member, the next sheet overlapping with that overlap portion is pulled out so that its end portion is partially protruded from the opening, after the upper sheet was taken out, and is allowed to be subsequently taken out.

The sheet stacks 1 and 5 can be manufactured as follows: At first, band sheets are continuously unwound from individual roll goods in a number corresponding to the number of the sheets to be stacked. Then, by using a guide plate, each band sheet is folded along a longitudinal direction (flow direction) thereof into the v-folded structure shown in FIG. 12 or into the z-folded structure shown in FIG. 13. Simultaneously with this v-folding or z-folding step, upper and lower sheets are so combined as to overlap each other with the aforementioned overlap portion. As the aforementioned steps are performed for every band sheets, there is formed a band-shaped sheet stack in which band sheets are folded and combined as shown in FIG. 12 or FIG. 13. This band-shaped sheet stack is cut to a predetermined length to manufacture the individual sheet stacks. This sheet stack is impregnated with a liquid into a wet state and is packaged in the packaging bag.

In the case where each sheet is folded once into such a v-folded sheet as shown in FIG. 12 or folded twice into such a z-folded sheet as shown in FIG. 13, the folding number of each sheet is so small that it is possible to combine upper and lower sheets simultaneously with the folding of the lower sheet such that a portion of the upper sheet is sandwiched between folds of the lower sheet.

However, if an original entire width (i.e., width before folded) of the sheet is 190 mm or 200 mm and if the width La or Lb of the overlap portion is set at 30 mm most preferable for the stack of the wet sheets, for example, the width of the sheet stack 1 or 5 becomes too large. In the case where the v-folded sheets are combined as shown in FIG. 12, the sheet stack has a width of about 170 mm. In case where the z-folded sheets are combined as shown in FIG. 13, on the other hand, the sheet stack has a width of about 85 mm. Accordingly, it is difficult to accommodate the sheet stack in a small-sized packaging member suitable for potable use, for example.

In order to provide a sheet stack having a smaller width from the sheets having the original width of 190 mm or 200 mm, therefore, it is necessary to increase the folding number of the individual sheets. However, when each sheet is to be folded along three or more fold lines into a sheet folding structure having four or more layers, it becomes difficult to adopt the aforementioned folding step, at which upper and lower sheets are combined simultaneously with the folding of the lower sheet. When each sheet is to be folded into four or more layers and the upper and lower sheets are to be combined simultaneously with this folding, more specifically, the structure of the guide plate (generally called "sailor") is extremely complicated. Even if this folding should be possible, on the other hand, the precision of the folding width would be difficult to keep.

In order to avoid the foregoing problems while folding each sheet in a large folding number and combining the upper and lower sheets, for example, Japanese Unexamined Patent Publication No. Heisei 10-174663 (174663/1998) discloses a folding process in which a band sheet is folded along a longitudinal direction (flow direction) thereof and is then folded back along a direction perpendicular to the longitudinal direction thereby to increase the folding number. However, if the sheet is folded back in the direction perpendicular to the flow direction, the flow velocity of the sheet for forming the sheet stack is difficult to speed up with a resultant defect that the mass productivity is lowered.

SUMMARY OF THE INVENTION

The present invention has been worked out in view of the problems set forth above. An object of the present invention is to provide a sheet stack manufacturing process for manufacturing a compact sheet stack in a high mass productivity.

According to the invention, there is provided a sheet stack manufacturing process comprising:

feeding a plurality of band sheets;

folding each band sheet at least once along a longitudinal direction thereof at a first folding step, to form folded bands;

folding each folded band along the longitudinal direction at a second folding step to have at least three fold lines by the first and second folding steps and to sandwich a portion of at least one of an overlying sheet and an underlying sheet thereof, thereby to form a band-shaped sheet stack in which a plurality of sheets are combined with one another so as to be stacked on one another; and cutting the band-shaped sheet stack to a predetermined length to be separated into individual sheet stacks.

For example, at the first folding step, each band sheet may be folded only once into a two-folded band having upper and lower folds, and at the second folding step, the upper and lower folds of each two-folded band may be folded together in one direction so as to sandwich a portion of at least one of an overlying sheet and an underlying sheet thereof.

In an alternative, at the first folding step, each band sheet may be folded only once into a two-folded band having upper and lower folds, and at the second folding step, the upper and lower folds of each two-folded band may be folded in opposite directions so as to sandwich a portion of an overlying sheet thereof with folding of the upper fold at the second folding step and sandwich a portion of an underlying sheet thereof with folding of the lower fold at the second folding step.

In another alternative, at the first folding step, each band sheet may be folded twice into a three-folded band, and at the second folding step, a portion of each three-folded band may be folded so as to sandwich a portion of at least one of an overlying sheet and an underlying sheet thereof.

In the sheet stack, preferably, all the sheets are subjected to the first and second folding steps and folding structures are symmetric between upper and lower sheets.

As set forth, the individual band sheets are folded into the folded bands at the first folding step prior to the second folding step. Then, the individual folded bands are fed to the second folding step and further folded to be combined with another sheet. Therefore, it is possible to make such a complicated folding structure as has never been practiced in the related art. In this folding structure, for example, four or more folds are overlapped in the thickness direction, and the upper and lower sheets are combined. In addition, since all the fold lines extend in the longitudinal direction (flow direction) of the band sheet, the manufacture line can be speeded up.

Here, it is also possible that other band sheets, as fed without being subjected to the first folding step, are folded simultaneously with the second folding step to have at most two fold lines and to be combined with the folded bands subjected to the first and second folding steps so that folding structures are different between upper and lower sheets in the sheet stack.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENTS

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific detailed. In the other instance, well known structure are not shown in detail in order to avoid unnecessary obscurity of the present invention.

Figure 1:
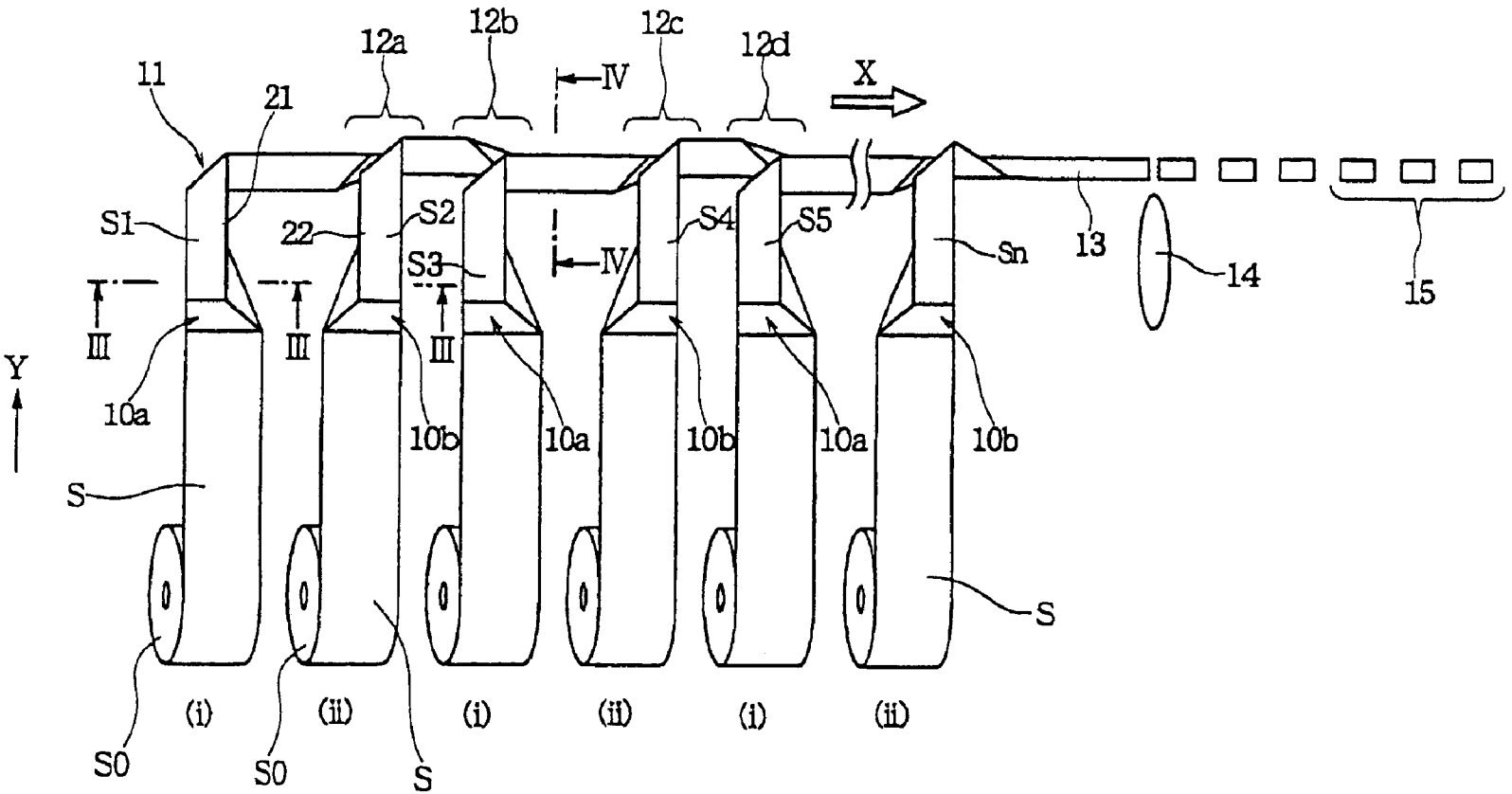
FIG. 1 is an explanatory view showing a sheet stack manufacturing process according to a first embodiment of the invention.
Figure 2B:
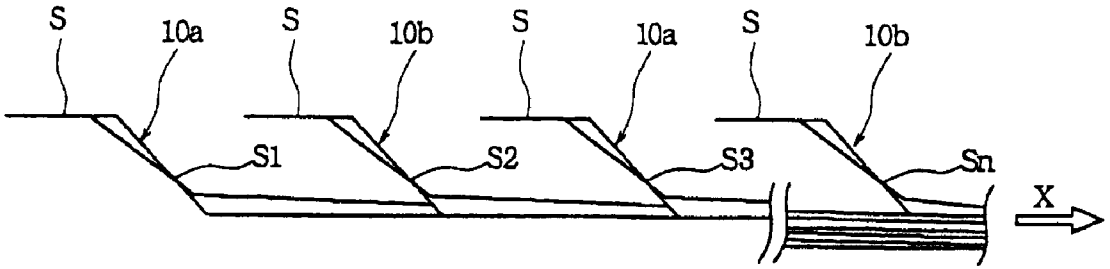
FIGS. 2A and 2B are explanatory views showing a modification of the sheet stack manufacturing process shown in FIG. 1.
Figure 2A:
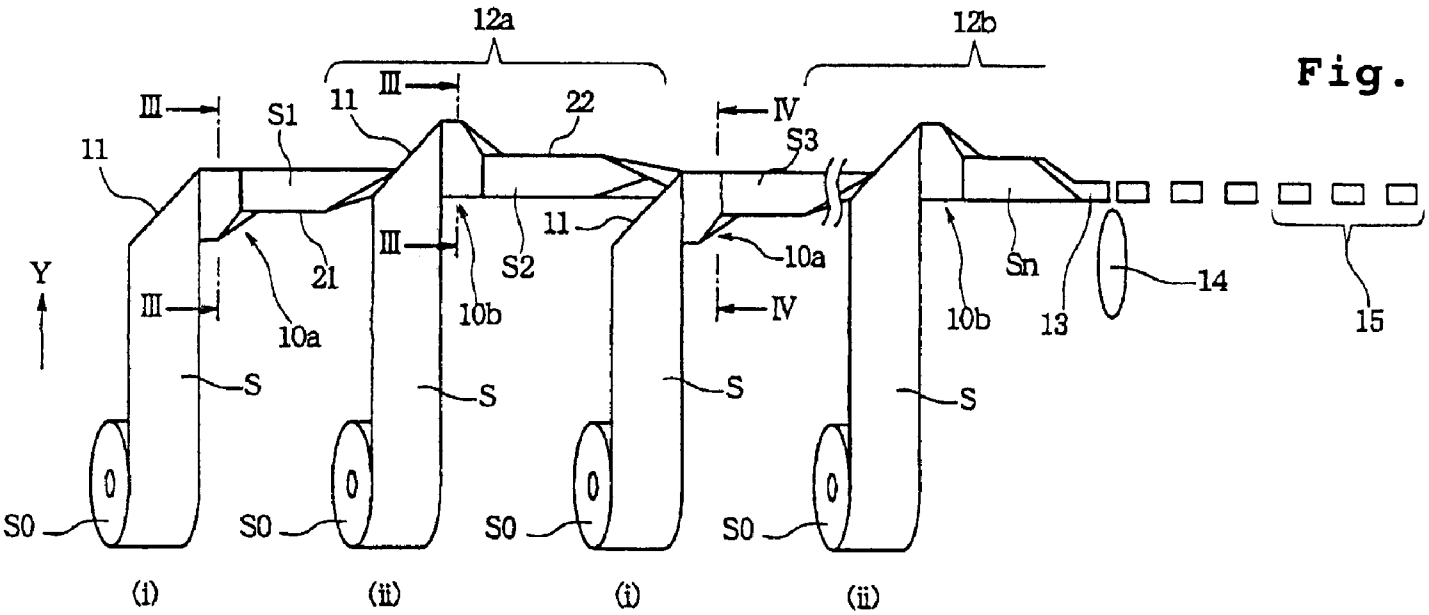

FIG. 1 is an explanatory view (flow chart) showing a sheet stack manufacturing process according to one embodiment of the invention; and FIGS. 2A and 2B are explanatory views showing a modification of the sheet stack manufacturing process shown in FIG. 1. In both processes shown in FIG. 1 and FIGS. 2A and 2B, band sheets S are unwound from roll goods S0 which are provided in a number corresponding to the number of sheets to be stacked in a completed sheet stack. In FIG. 1 and FIGS. 2A and 2B, the band sheets S are alternately indicated by (i) and (ii) from the left-hand side. Band sheets indicated by (i) are hereinafter designated "odd number band sheets"; and band sheets indicated by (ii) are hereinafter designated "even number band sheets".

Each sheet S is a paper or nonwoven fabric. For example, the sheet S may be a water-undecomposable paper made of pulp and containing a binder, or a water-undecomposable nonwoven fabric such as a spunlaced nonwoven fabric made of regenerated cellulose fibers such as rayon, or regenerated cellulose fibers and synthetic resin fibers.

In an alternative, the sheet S may be a water-decomposable (water-disintegratable) sheet, of which fibers can be dispersed with a large amount of water when it is disposed of into a flush toilet after use. The water-decomposable sheet is exemplified by: a paper or nonwoven fabric made of fibers of rayon or pulp and containing a binder such as water-soluble or water-swellable CMC (carboxymethyl cellulose); a nonwoven fabric prepared by interlacing rayon fibers of a length of 10 mm or less or 7 mm or less with water jets (which can be decomposed in such a manner that entanglement of the rayon fibers is undone with a large amount of water applied); or a paper or nonwoven fabric made of rayon or pulp and containing fibrillated rayon for acting as a binder.

These individual sheets S are stacked to form a sheet stack and are then impregnated with water or chemical into a wet state until they are packaged in a packaging material such as packaging bag.

According to the sheet stack manufacturing method shown in FIG. 1, the band sheets S are unwound from the roll goods S0 in a Y-direction. In the course of unwinding in the Y-direction, the band sheets S indicated by (i) (i.e., odd number band sheets (i)) are folded in two at a first folding step 10*a* to form two-folded bands S1, S3, S5, . . . , and so on, and the band sheets S indicated by (ii) (i.e., even number band sheets (ii)) are folded in two at a first folding step 10*b* to form two-folded bands S2, S4, S6, . . . , and so on. At this time, each band sheet S is folded in two along a flow direction (i.e., Y-direction) thereof. Here, the folded bands S1, S3, S5, . . . , and so on folded from the odd number band sheets (i) and the folded bands S2, S4, S6, . . . , and so on folded from the even number band sheets (ii) are folded symmetrically at the first folding steps 10*a* and 10*b*. Then, both the folded bands S1, S3, S5, . . . , and so on folded in two at the first folding step 10*a* and the folded bands S2, S4, S6, . . . , and so on folded in two at the first folding step 10*b* are turned in an X-direction perpendicular to the Y-direction at turning portions 11 so that all the folded bands flow in the X-direction.

In each turning portion 11, there is arranged a folding guide plate or a folding roller which takes an angle of 45 degrees with respect to the X-direction and the Y-direction.

Thereafter, each folded band thus turned in the X-direction is further folded along the X-direction at a second folding step. Specifically, the folded band S1, as located at the most left-hand position of FIG. 1, is further folded along the X-direction at a second folding step 12*a*. At this time, the folded band S1 is so folded as to be combined with the next folded band S2. Similarly, the folded band S2 is further folded along the X-direction at a second folding step 12*b* and is combined with the next folded band S3. Thus, second folding steps 12*c*, 12*d*, . . . , and so on are sequentially repeated to form a band-shaped sheet stack 13 in which upper and lower sheets are combined. This band-shaped sheet stack 13 is cut by a cutter 14 to manufacture individual sheet stacks 15.

The sheet stack manufacturing process shown in FIGS. 2A and 2B differs from the process shown in FIG. 1 in that each sheet S, as unwound from each roll goods S0 in the Y-direction, is turned in the X-direction at the turning portion 11 prior to the first folding step. After turned in the X-direction, each odd number band sheet (i) is folded in two along the X-direction at the first folding step 10*a* to form the folded bands S1, S3, S5, . . . , and so on, and each even number band sheet (ii) is folded in two along the X-direction at the first folding step 10*b* to form the folded bands S2, S4, S6, . . . , and so on. The odd number band sheets (i) and the even number band sheets (ii) are symmetric with respect to the folding directions.

Then, as shown in FIGS. 2A and 2B, the most left-hand folded band S1 is further folded at the second folding step 12*a* to be combined with the next folded band S2. At the next second folding step 12*b*, moreover, the folded band S2 is folded to be combined with the next folded band S3. These folding operations are repeated to form the band-shaped sheet stack 13 having its sheets overlapped. This band-shaped sheet stack 13 is cut by the cutter 14 into the individual sheet stacks 15.

Here, the individual sheets S are folded, while being fed obliquely downward, at the first folding step and at the second folding step, as shown in FIG. 2B. In the process shown in FIG. 1, too, after the folded bands S1, S2, . . . , and so on are turned in the X-direction at the turning portion 11, the individual folded bands are fed obliquely downward, as in FIG. 2B, to be folded at the second folding step.

Figure 3A:
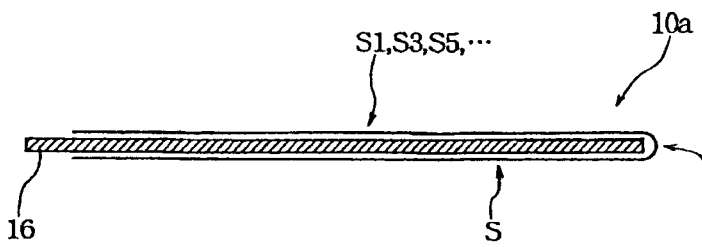
FIGS. 3A and 3B are explanatory views showing first folding steps of the first embodiment.
Figure 3B:
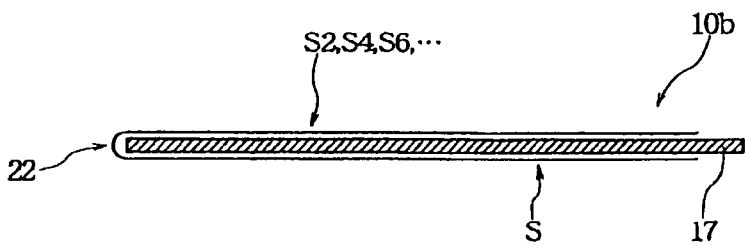

FIGS. 3A and 3B show the first folding steps 10*a* and 10*b* in the sheet stack manufacturing processes shown in FIG. 1 and FIGS. 2A and 2B, and present sectional views taken along lines III—III of FIGS. 1 and 2A.

At the first folding steps 10*a* and 10*b*, the band sheets S are folded by guide plates 16 and 17 called "sailor" to form the folded bands S1, S2, S3, S4, S5, S6, . . . , and so on. Among them, the folded bands S1, S3, S5, . . . , and so on folded in two at the first folding step 10*a* are each formed with one fold line 21 extending in the longitudinal direction (or the flow direction) of the sheet, and the folded bands S2, S4, S6, . . . , and so on folded in two at the first folding step 10*b* are each formed with one fold line 22 extending in the longitudinal direction of the sheet.

Figure 4:
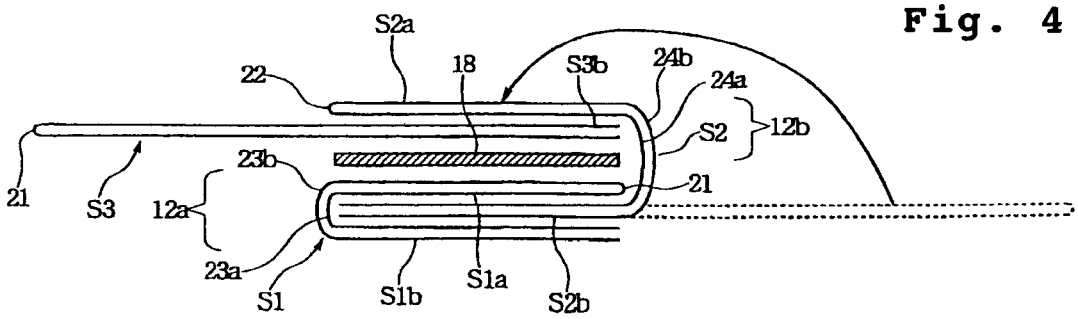
FIG. 4 is an explanatory view showing second folding steps of the first embodiment.

FIG. 4 shows the second folding steps 12*a* and 12*b* and presents a sectional view taken along lines IV—IV of FIGS. 1 and 2A.

First of all, at the second folding step 12*a*, upper and lower folds of the folded band S1 are folded together in the same direction. By this folding operation at the second folding step 12*a*, two fold lines 23*a* and 23*b* are simultaneously formed in the band sheet S. The resulting sheet has a two-ply lower portion S1*b* and a two-ply upper portion S1*a*. Simultaneously with this, such a portion of the folded band S2 to be fed next as to form a two-ply lower portion S2*b* is sandwiched between the two-ply lower portion S1*b* and the two-ply upper portion S1*a*.

At the next second folding step 12*b*, the folded band S2 is folded so that its upper and lower folds are folded together in the same direction by the single folding operation thereby to form two fold lines 24*a* and 24*b* simultaneously in the longitudinal direction. At this time, a two-ply upper portion S2*a* is folded on such a portion of the folded band S3 to be fed next as to form a two-ply lower portion S3*b*, so that the folded band S3 is sandwiched between the two-ply upper portion S2*a* and the two-ply lower portion S2*b*. At each second folding step, too, a guide plate 18 acting as the sailor is used in combination.

Figure 5:
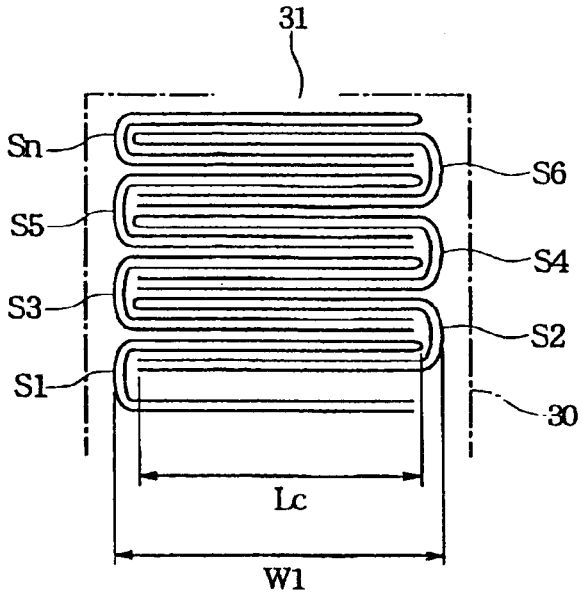
FIG. 5 is a front elevation showing a sheet stack which has been formed by the folding steps of the first embodiment.

Thus, a number of sheets are folded and stacked to form the band-shaped sheet stack 13, which is then cut by the cutter 14 to form such a sheet stack as shown in FIG. 5. In the sheet stack of FIG. 5, the two-folded bands S1, S2, S3, . . . , and Sn are further folded and combined with one another. In each sheet, there are formed the three fold lines 21, 23*a* and 23*b* or the three fold lines 22, 24*a* and 24*b*. On the other hand, the folding directions are symmetric between the odd number sheets and the even number sheets. Moreover, the two-ply lower portion of each sheet and the two-ply upper portion of the underlying sheet are overlapped with an overlap portion of a width Lc. In case where the sheets are wet, the upper and lower sheets are joined (closely contacted) to each other at the overlap portion by a water film. The overlap width Lc is preferably about 30±20 mm.

This sheet stack is packaged in a packaging member 30 which is formed of a packaging sheet. An opening 31 is formed in the upper face of the packaging member 30. From this opening 31, the sheets composing the sheet stack are taken out (dispensed) one by one. At this time, since one sheet taken out has the overlap portion with the underlying next sheet, the next sheet is left in the packaging member 30 with its portion being protruded from the opening 31, thereby to facilitate the take-out of the next sheet.

When the band sheets S have a width of 190 mm or 200 mm, for example, the sheet stack shown in FIG. 5 can have a width W1 which is one quarter or slightly larger than one quarter of the width (190 mm or 200 mm) of the band sheets S. Therefore, there can be provided a compact final product in which the sheet stack is packaged in a packaging member 30. Moreover, since each sheet is folded in two before combined with another sheet, it is taken out in the two-folded state from the opening 31. Therefore, even when a water-undecomposable wet sheet having a low tensile strength is used, it is pulled in the two-folded state and is hardly broken.

In the foregoing sheet stack manufacturing processes, the individual band sheets are firstly folded in two to form the two-folded bands and then the upper and lower folds of the two-folded bands are folded together in the same direction. However, the sheet stack manufacturing process of the invention should not be limited thereto. By adapting the first and/or second folding steps, there may be manufactured a sheet stack having a complicated folding structure.

Figure 6A:
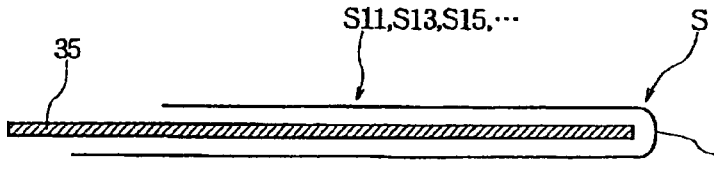
FIGS. 6A and 6B are explanatory views showing first folding steps of a second embodiment.
Figure 6B:
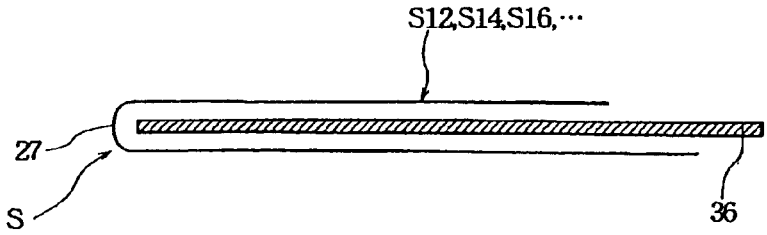
Figure 7:
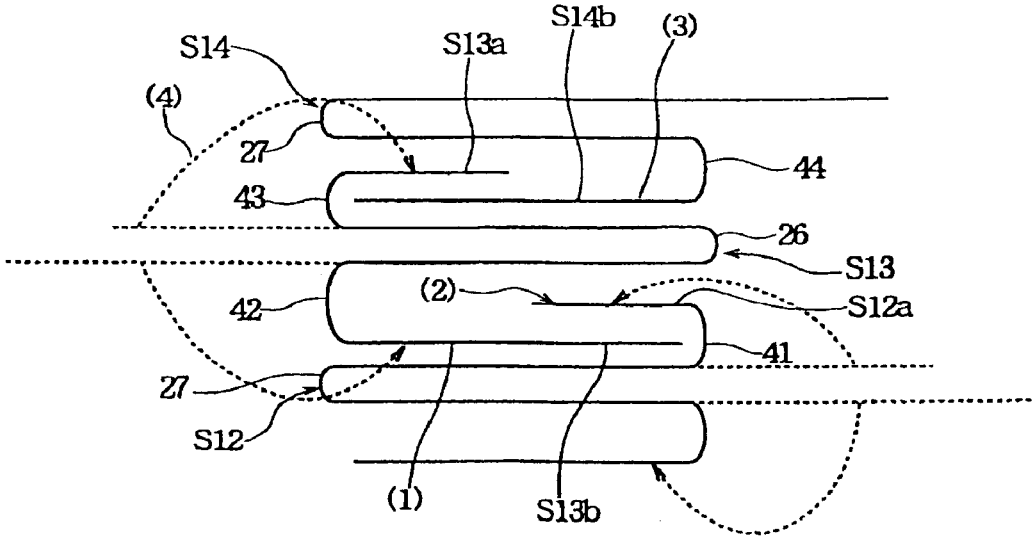
FIG. 7 is an explanatory view showing second folding steps of a second embodiment.
Figure 10:
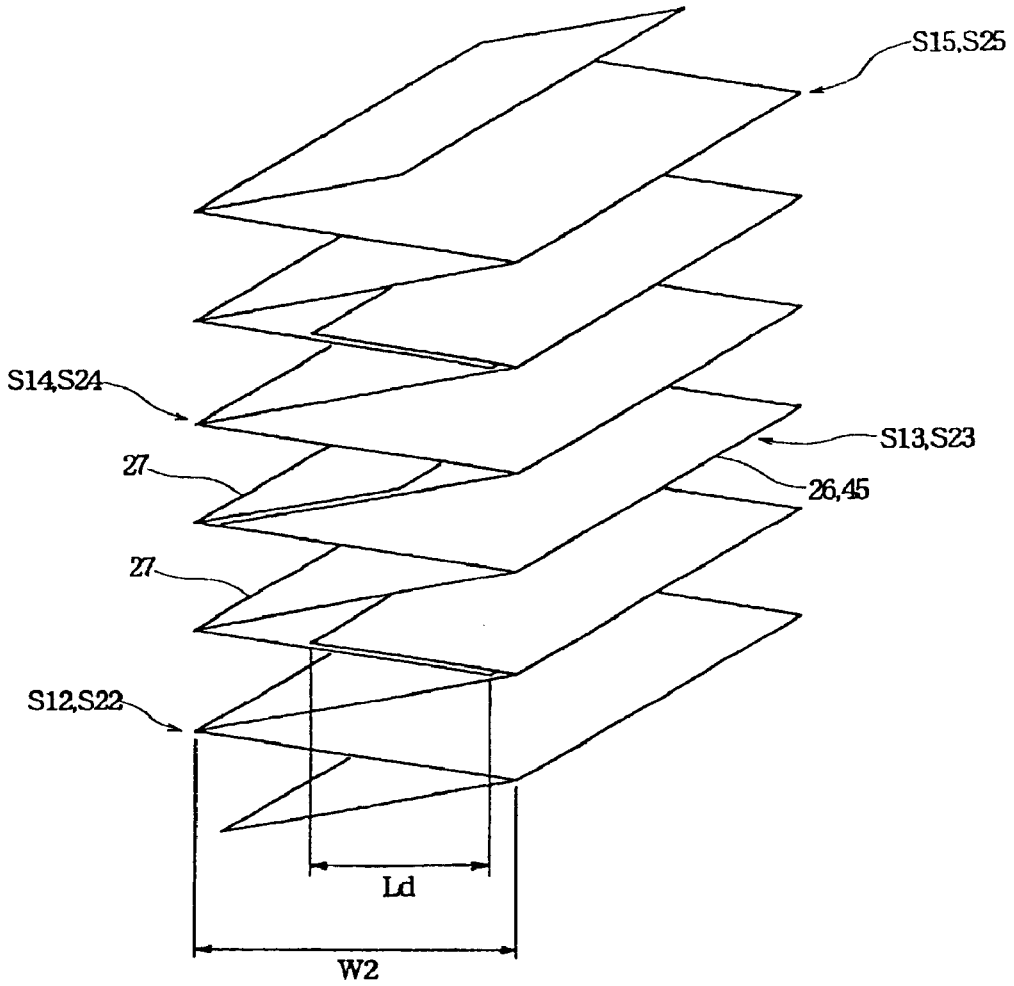
FIG. 10 is a perspective view showing a sheet stack which has been formed by the folding steps of the second embodiment or the third embodiment.

FIGS. 6A and 6B and FIG. 7 show first and second folding steps according to a second embodiment of the invention, for manufacturing a sheet stack having such a folding structure as shown in FIG. 10.

At the first folding step shown in FIG. 6A, the individual odd number band sheets (i) are folded in two along one fold line 26 extending in the longitudinal direction thereof by a guide plate 35, thereby to form folded bands S11, S13, S15, . . . , and so on. At the first folding step shown in FIG. 6B, on the other hand, the individual even number band sheets (ii) are folded in two along one fold line 27 extending in the longitudinal direction thereof by a guide plate 36, thereby to form folded bands S12, S14, S16, . . . , and so on.

Then, the folded bands S11, S12, S13, S14, S15, S16, . . . , and so on are folded at the second folding step to be combined with one another, as shown in FIG. 7. In FIG. 7, the folded band S13 is fed to over the folded band S12. At this time, the lower fold of the folded band S13 is further folded back along a fold line 42 to form a lower fold S13*b*. Simultaneously with this, the upper fold of the underlying folded band S12 is further folded back along a fold line 41 to form an upper fold S12*a*. This upper fold S12*a* is laid over the lower fold S13*b*. These folding procedures are indicated by (1) and (2). Then, the folded band S14 is fed to over the folded band S13. At this time, the lower fold of the folded band S14 is further folded back along a fold line 44 to form a lower fold S14*b*. Simultaneously with this, the upper fold of the underlying folded band S13 is further folded back along a fold line 43 to form an upper fold S13*a*. This upper fold S13*a* is laid over the lower fold S14*b*. These folding procedures are indicated by (3) and (4). A band-shaped sheet stack thus formed is cut by the cutter 14 into the individual sheet stacks.

Figure 8A:
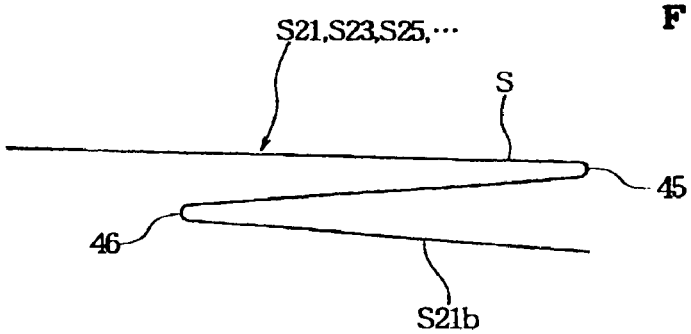
FIGS. 8A and 8B are explanatory views showing first folding steps of a third embodiment.
Figure 8B:
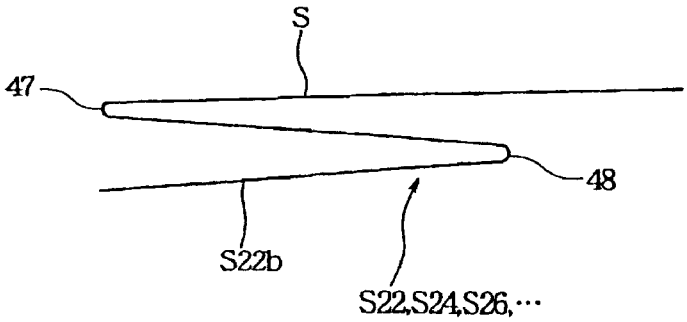
Figure 9:
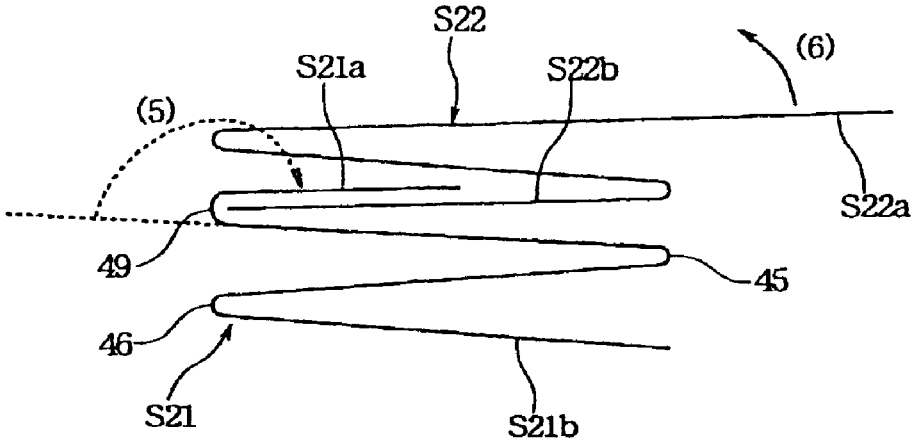
FIG. 9 is an explanatory view showing second folding steps of a third embodiment.

FIGS. 8A and 8B and FIG. 9 show first and second folding steps according to a third embodiment of the invention, for manufacturing a sheet stack having the same folding structure as that of the foregoing second embodiment.

At the first folding step, as shown in FIGS. 8A and 8B, the band sheet S of a predetermined width is folded along two fold lines extending in the longitudinal direction to form a three-folded band having an upper, intermediate and lower folds Specifically, at the first folding step shown in FIG. 8A, the individual odd number band sheets (i) are folded along two fold lines 45 and 46 extending in the longitudinal direction thereof, thereby to form z-folded bands S21, S23, S25, . . . , and so on. At the first folding step shown in FIG. 8B, on the other hand, the individual even number band sheets (ii) are folded along two fold lines 47 and 48 extending in the longitudinal direction thereof, thereby to form z-folded bands S22, S24, S26, . . . , and so on. As shown in FIGS. 8A and 8B, the folded bands S21, S23, S25, . . . , and so on and the folded bands S22, S24, S26, . . . , and so on are symmetric in their folding structures.

Then, as shown in FIG. 9, the folded band S22 is fed to over the underlying folded band S21. At this time, the upper fold of the underlying folded band S21 is further folded back along a fold line 49 to form an upper fold S21*a*, which is laid over a lower fold S22*b* of the overlying folded band S22. Then, the folded band S23 is fed to over the folded band S22. At this time, the upper fold of the folded band S22 is further folded back, as indicated by (6), to form an upper fold S22*a*, which is laid over a lower fold of the overlying folded band S23. Thus, a band-shaped sheet stack can be formed by repeating the second folding steps sequentially in the order of (5), (6), . . . , and so on shown in FIG. 9, and is then cut by the cutter 14 into the individual sheet stacks.

FIG. 10 shows the sheet stack which has been formed either by the process shown in FIGS. 6A, 6B and 7 or by the process shown in FIGS. 8A, 8B and 9.

In this sheet stack, the individual sheets are folded along the three fold lines into a four-ply structure. Moreover, the folding structures are symmetric between the odd number sheets and the even number sheets, and the upper and lower sheets are overlapped and joined with an overlap portion of a width Ld (e.g., 30±20 mm). This sheet stack may also be dimensioned so compactly as to have an entire width W2 which is one quarter or about one quarter of the width of the band sheet.

Figure 11:
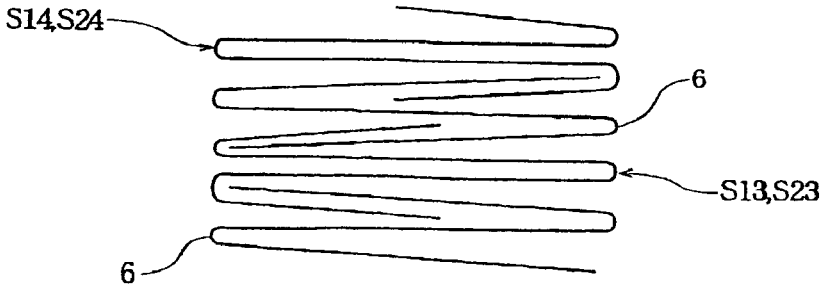
FIG. 11 is a front elevation of a sheet stack which has been formed by folding steps of still another embodiment.
Figure 12:
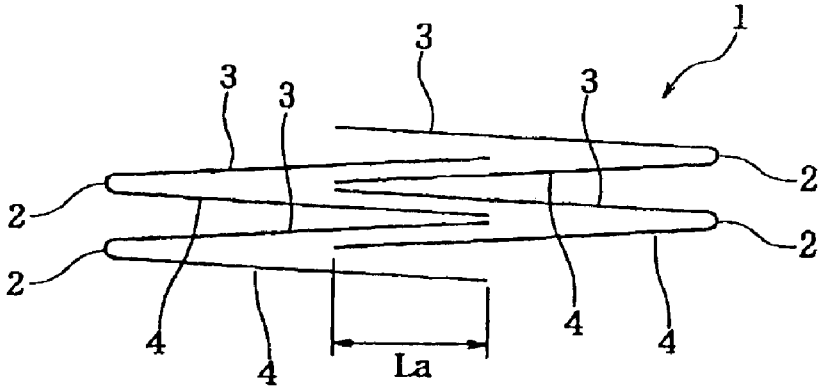
Fig. 12 PRIOR ART
FIG. 12 is a front elevation of a sheet stack of the related art.
Figure 13:
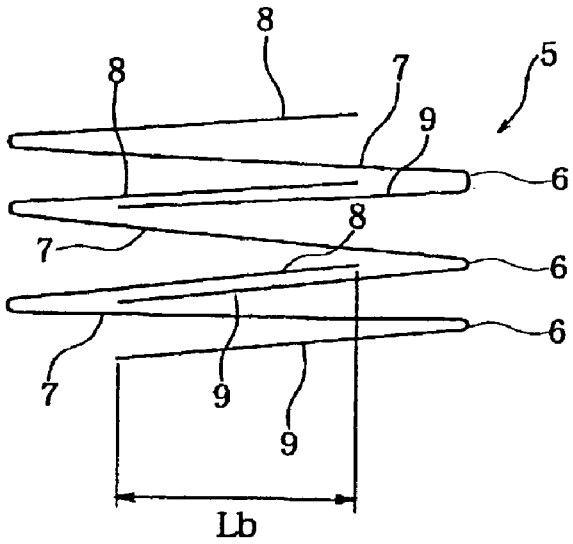
Fig. 13 PRIOR ART
FIG. 13 is a front elevation of another sheet stack of the related art.

FIG. 11 shows a sheet stack which is manufactured by a sheet stack manufacturing process according to still another embodiment of the invention. In this sheet stack, z-folded sheets 6 having the same folding structures as those of the related art shown in FIG. 13 are sandwiched between the upper and lower sheets shown in FIG. 10. Specifically, the sheet stack of FIG. 11 is manufactured by feeding unfolded band sheets between the folded bands which have been folded at the first folding step, folding the unfolded band sheets into z-folded bands simultaneously with folding of the folded bands (e.g., S13 or S 23 and S14 or S24) at the second folding steps, so that the z-folded band for forming the z-folded sheet 6 is combined with the folded band S13 or S23 and the folded band S14 or S24, and cutting a band-shaped sheet stack thus formed by the cutter 14 into individual sheet stacks.

According to the invention, as has been described hereinbefore, the folded sheets having four or more folds can be readily combined to another sheet. On the other hand, since all the fold lines extend in the flow direction of the sheet, the manufacture line can be speeded up.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A sheet stack manufacturing process comprising:

feeding a plurality of band sheets onto a respective folding guide plate or a folding roller;

folding each band sheet in the plurality of band sheets longitudinally into two-folded band sheets such that two adjacent band sheets in the sheet stack are folded in opposite directions;

refolding each two-folded band sheet longitudinally to provide four folds, said plurality of band sheets being combined with each other and stacked one on top of another to form a band-shaped sheet stack such that, upon folding a first two-folded band sheet, a portion of a second two-folded band sheet, which is a subsequent sheet that is immediately folded, is laid on a first band sheet and combined with the first band sheet; and cutting the band-shaped sheet stack to a predetermined length for separation into individual sheet stacks.

2. A sheet stack manufacturing process comprising:

feeding a plurality of band sheets onto a respective folding guide plate or a folding roller;

folding each band sheet in the plurality of band sheets longitudinally to form a two-folded band sheet having an upper fold and a lower fold;

folding each two-folded band sheet longitudinally such that the upper fold is upwardly folded upon itself and the lower fold is downwardly folded upon itself, said plurality of band sheets being combined with each other and stacked one on top of another to form a band-shaped sheet stack such that, upon folding an upper fold of a first two-folded band sheet, a lower fold of a second two-folded band sheet, which is supplied over a first band sheet, is simultaneously folded and combined with the first band sheet; and cutting the band-shaped sheet stack to a predetermined length for separation into individual sheet stacks.

3. A sheet stack manufacturing process comprising:

feeding a plurality of band sheets onto a respective folding guide plate or a folding roller;

folding each band sheet in the plurality of band sheets longitudinally to form a three-folded band sheet having an upper fold, an intermediate fold and a lower fold;

folding each three-folded band sheet longitudinally such that the upper fold is upwardly folded upon itself, said plurality of band sheets being combined with each other and stacked one on top of another to form a band-shaped sheet stack such that, upon folding the upper fold of a first three-folded band sheet, the lower fold of a second three-folded band sheet is laid on the upper fold of the first three-folded band sheet and combined with a first band sheet; and cutting the band-shaped sheet stack to a predetermined length for separation into individual sheet stacks.

4. A sheet stack manufacturing process comprising:

alternately feeding first band sheets and second band sheets onto a respective folding guide plate or a folding roller;

folding each first band sheet longitudinally to form a two-folded band sheet having an upper fold and a lower fold;

folding each two-folded band sheet longitudinally such that the upper fold is upwardly folded upon itself and the lower fold is downwardly folded upon itself and each second band sheet is folded into a three-folded band sheet having an upper fold, an intermediate fold and a lower fold, said first band sheets and the second band sheets being combined with each other and stacked one on top of another to form a band-shaped sheet stack such that, upon folding the upper fold of a two-folded first band sheet, a second band sheet, which is supplied over the two-folded first band sheet, is folded to have the lower fold, and upon folding the lower fold of another two-folded first band sheet, which is supplied over the second band sheet, the second band sheet is further folded to have the upper fold; and cutting the band-shaped sheet stack to a predetermined length for separation into individual sheet stacks.

* * * * *